United States Patent [19]

Barlow

[11] 3,975,019

[45] Aug. 17, 1976

[54] PINBALL TYPE GAME APPARATUS

[75] Inventor: Gordon A. Barlow, Skokie, Ill.

[73] Assignee: Marvin Glass & Associates, Chicago, Ill.

[22] Filed: Feb. 27, 1974

[21] Appl. No.: 446,142

[52] U.S. Cl. ..... 273/121 A; 200/61.11; 273/127 R; 273/127 C; 273/129 A; 273/129 G; 273/DIG. 26

[51] Int. Cl.[2] ..... A63D 3/02; A63D 13/00; A63D 15/20

[58] Field of Search ..... 273/85 A, 85 E, 87.2, 273/87.4, 88, 89, 111, 118 R, 118 A, 118 D, 119 R, 119 A, 120 R, 120 A, 121 R, 121 A, 122 R, 122 A, 123 R, 123 A, 124 R, 124 A, 125 R, 125 A, 126 R, 126 A, 127 R, 127 B, 127 C, 129, DIG. 26, 11 R, 11 C

[56] References Cited

UNITED STATES PATENTS

| | | | |
|---|---|---|---|
| 1,127,861 | 2/1915 | Conner et al. | 273/87.4 |
| 1,714,905 | 5/1929 | Dieterich | 273/125 R |
| 2,042,786 | 6/1936 | Hooker | 273/121 A |
| 2,192,608 | 3/1940 | Butterworth | 273/129 |
| 3,488,054 | 1/1970 | Brzoska | 273/11 R |

FOREIGN PATENTS OR APPLICATIONS

| | | | |
|---|---|---|---|
| 1,099,385 | 3/1955 | France | 273/123 R |
| 2,161,963 | 6/1972 | Germany | 273/121 R |
| 364,468 | 1/1932 | United Kingdom | 273/125 R |

*Primary Examiner*—Richard T. Stouffer
*Attorney, Agent, or Firm*—Coffee and Sweeney

[57] ABSTRACT

A pinball apparatus including a housing having an inclined playing surface over which a ball may be propelled and at least one ball to be propelled on the playing surface. A launcher is provided for propelling the ball onto the playing surface, and target members are mounted on the playing surface for striking by the ball. A flipper assembly is provided for keeping the ball in play on the playing surface. A scorer is associated with the target members for registering a score everytime a target member is struck by a ball. The apparatus includes a tunnel assembly having an inclined channel formed within the housing beneath the playing surface. An entrance is provided on the playing surface for capturing a ball and allowing the ball to be introduced into one end of the tunnel and an exit is provided in the playing surface at the other end of the tunnel for allowing the ball to be introduced back onto the playing surface. The scorer includes a normally incomplete electrical circuit. The circuit includes a normally open bumper switch mounted in the target member, and an electronic switch for determining when electricity is to initially flow through the circuit. Connected with the electronic switch is a cycle interrupter switch for turning a transistor or electronic switch off after it is initially actuated as well as terminating the cycle of operation of the scorer. The flipper assembly includes a manually operable portion mounted for generally vertical reciprocal movement perpendicular to the playing surface and a linkage operably connecting said manually operable portion with flipper members for transmitting up and down reciprocal movement into reciprocal movement of the flipper members in a horizontal plane.

5 Claims, 12 Drawing Figures

10
12
14
14
232
228
237
266
230
268
106b
210
167
106c
208
214
104c
204
212
206
202
217
222
216
220b
220a
218a
218b
260
255
256
263
4
106a
156
158
166
170
172
174
184
178
180
182
186
188
192
194
176
190
160
162
34
140
145
154
142
146
150
4
86R
87R
88R
85R
92R
96R
90R
86L
87L
88L
85L
92L
90L
96L
78R
82R
94R
78L
94L
82L
76L
74R
76R
52R
74L
52L

PINBALL TYPE GAME APPARATUS

BACKGROUND OF THE INVENTION

1. Field of the Invention

The present invention relates to a pinball apparatus and particularly to new and improved features of a pinball apparatus.

2. Brief Description of the Prior Art

Pinball apparatus are well known as an amusement game or device. A conventional pinball apparatus generally includes a housing having an inclined playing surface over which a ball may be propelled, at least one ball to be propelled on the playing surface, a launcher for propelling a ball onto the playing surface, at least one target mounted on the playing surface for striking by a ball, a flipper assembly for striking a ball in order to keep the ball in play, and scoring means associated with the target for registering a score everytime the target is struck by a ball. Most flipper assemblies have a ball hitting portion rotatably mounted on the surface for striking the ball and actuating means for effecting rotation of the ball hitting portion. By the skillful use of the launcher and the flipper assembly a player attempts to gain as many "points" as possible during his turn.

SUMMARY OF THE INVENTION

The principal object of the present invention is to provide a new and improved pinball apparatus of the type described above.

One feature of the invention is a tunnel assembly to be used in combination with the above described pinball apparatus. The tunnel assembly generally includes an inclined channel formed within the housing beneath the playing surface, with an upper end and a lower end so that a ball in the channel will roll from its upper end to its lower end. Entrance means is provided on the playing surface above the upper end of the channel for capturing a ball and allowing the ball to be introduced into the channel. Exit means are provided between the lower end of the channel and the playing surface for allowing a rolling ball to be introduced back onto the playing surface in a position for further play adjacent the flippers.

Another feature of the present invention is an improvement in the scoring means. The scoring means generally includes a score indicator for visually indicating the number of accumulated points amassed by a particular player and means defining a normally incomplete electrical circuit. The electrical circuit includes an electrical power source, drive means operably associated with said indicator for driving said indicator, a normally open bumper switch mounted at the target so that the bumper switch closes momentarily in response to being struck by a ball, and an electronic switch for determining when electricity is to initially flow through the circuit. The electronic switch is changeable between a normally "off" nonconducting state wherein electricity does not flow through the electronic switch and the circuit, and an "on" state established by the momentary closing of the bumper switch. When the circuit commences to conduct electricity, the drive means actuates the indicator. An interrupter switch is connected in said circuit and associated with the drive means for turning said electronic switch to its "off" state and for stopping the flow of electricity through the circuit a predetermined time after the circuit commences to conduct electricity. The predetermined time defines a scoring period during which the drive means actuates the indicator.

Still another feature of the present invention is an improved actuating means for use in the flipper assembly. The improved actuating means generally includes a manually operable portion mounted for generally vertical reciprocal movement perpendicular to the playing surface and linkage means operably connecting the manually operable portion with the flipper members for transmitting the up and down reciprocal movement into reciprocal movement of the flipper members in a horizontal plane.

DESCRIPTION OF THE PREFERRED EMBODIMENT

Figure 1:
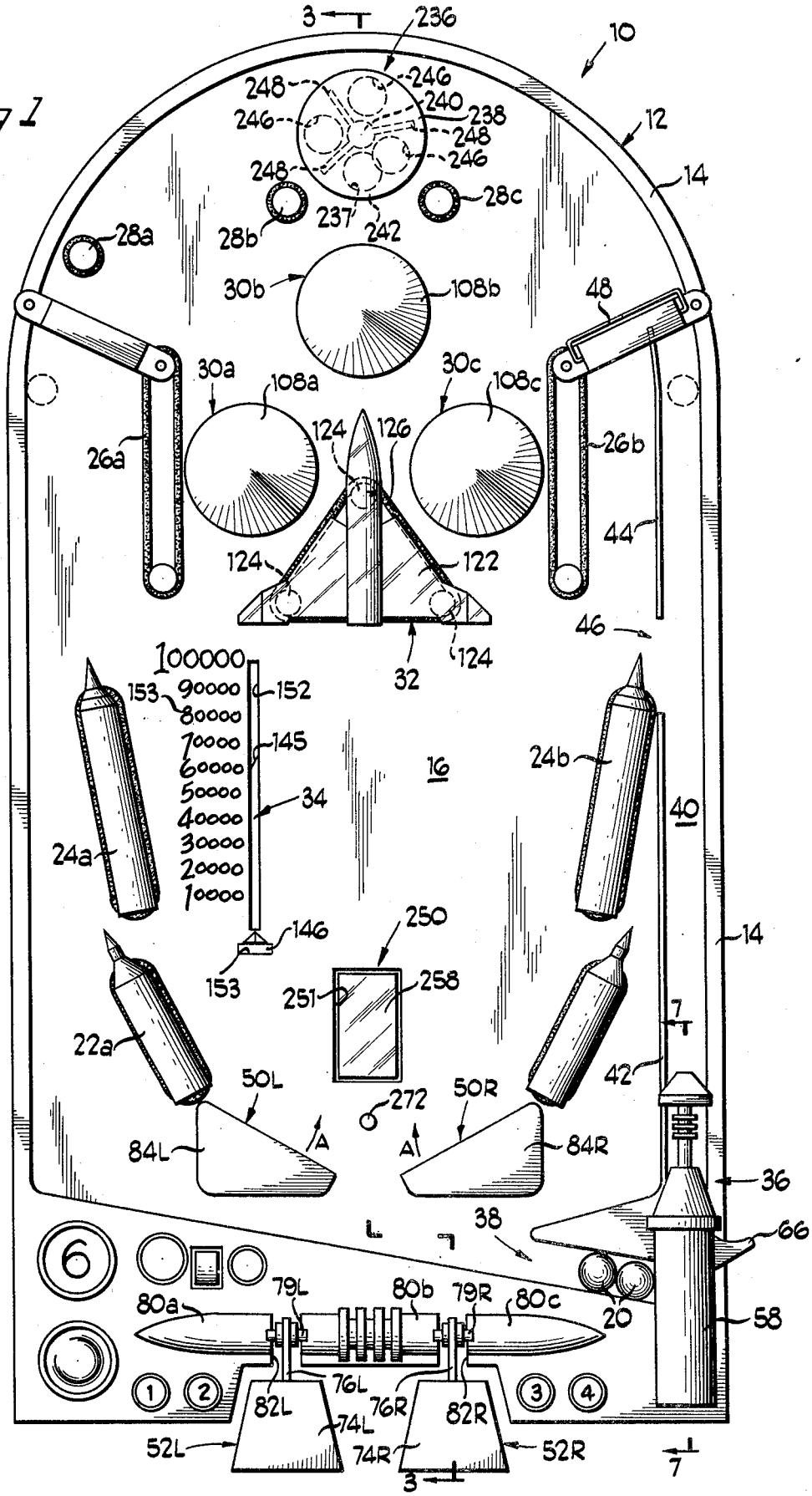
FIG. 1 is a top plan view of the pinball apparatus of the present invention.
Figure 2:
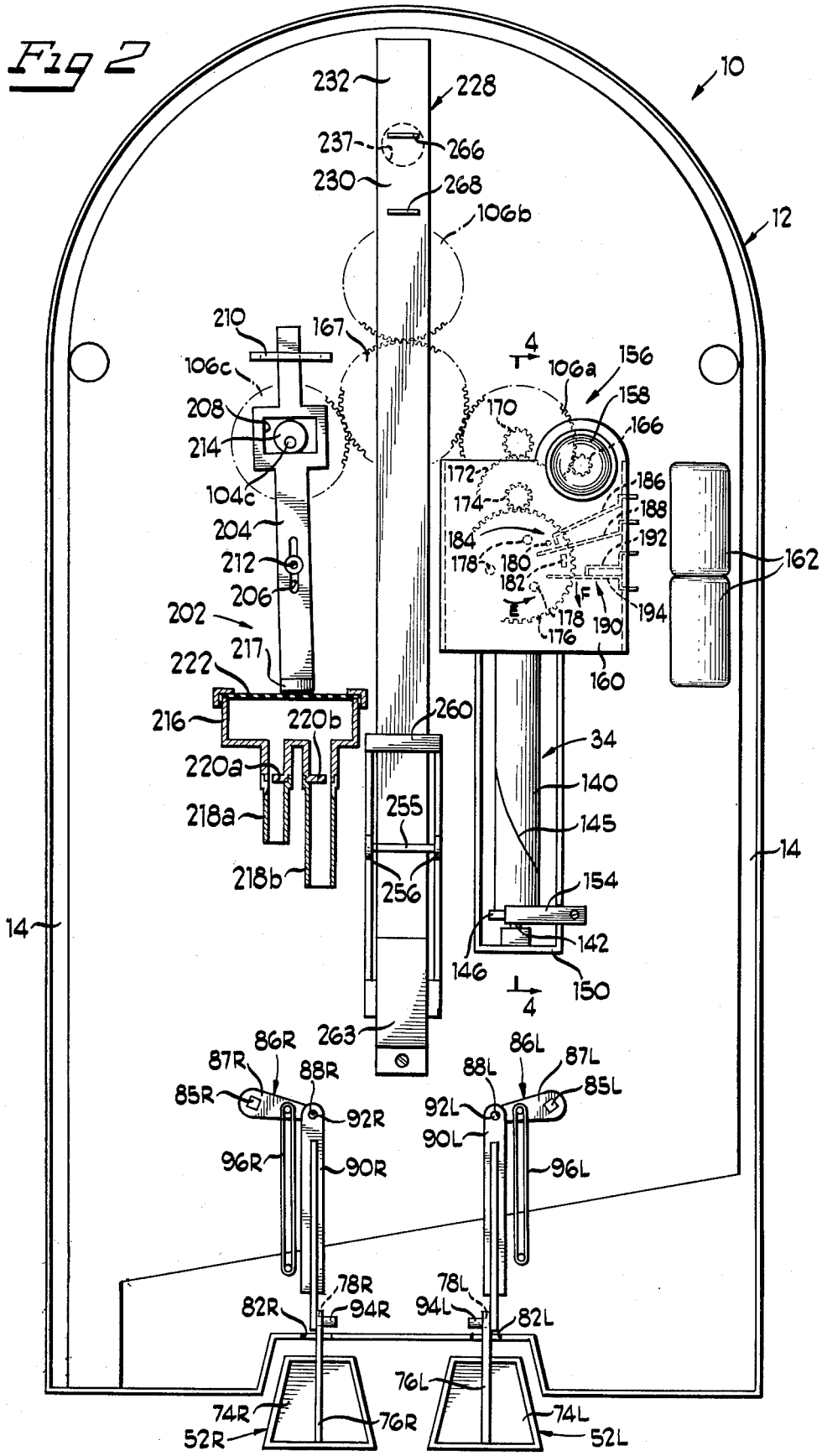
FIG. 2 is a bottom plan view of the pinball apparatus of the present invention.

Turning now to FIGS. 1 and 2 in greater detail, the pinball apparatus, generally designated 10, of the present invention is seen to generally comprise a housing 12 having bounding side walls 14. A generally flat playing surface 16 and a raised surface 18 form the top of the housing 12 between walls 14. The playing surface 16 is adapted to rollingly support a pinball 20.

Figures 3, 4, 6, 7, 8, 9:
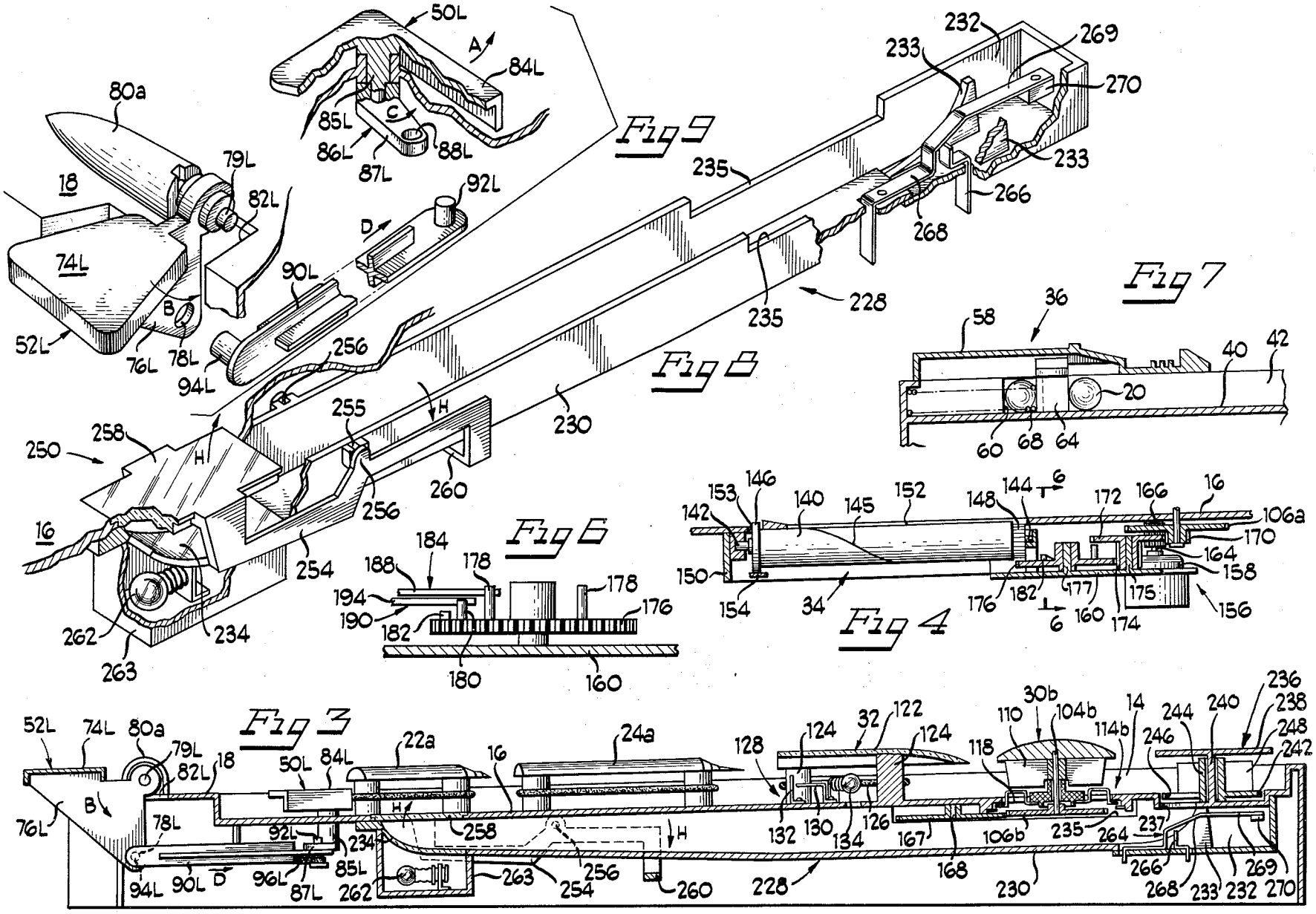
FIG. 3 is a sectional view taken generally along the line 3—3 of FIG. 1.
FIG. 4 is a sectional view taken generally along the line 4—4 of FIG. 2.
FIG. 6 is a generally enlarged sectional view taken generally along the line 6—6 of FIG. 4.
FIG. 7 is a sectional view taken generally along the line 7—7 of FIG. 1.
FIG. 8 is an enlarged perspective view of the tunnel assembly employed in the pinball apparatus of the present invention.
FIG. 9 is an enlarged, exploded and fragmentary perspective view of a portion of the flipper assembly employed in the pinball apparatus of the present invention.

Mounted on the playing surface 16 are a plurality of pinball bumpers 22*a*, 22*b*, 24*a*, 24*b*, 26*a*, 26*b*, 28*a*, 28*b* and 28*c* off of which the balls 20 are intended to be bounced as they roll on the surface. Also mounted on the playing surface 16 are three carousel or turret type targets 30*a*, 30*b* and 30*c*, and an airplane or rocket configured target 32. Everytime a ball 20 hits one of the targets 30*a*, 30*b*, 30*c* or 32, a score is visually indicated on a score indicator, generally designated 34 (FIGS. 1, 2 and 4).

Looking at FIG. 1, a spring biased pinball launcher, generally designated 36, is located at the bottom right-hand corner of the pinball apparatus 10 from which a ball 20 can be propelled onto the playing surface 16. A ball storage area 38 is formed immediately adjacent the launcher 36 where spent balls 20 are received. A ball 20 is launched by the launcher along a launching channel 40. The launching channel 40 is defined by the lateral walls 14 and two upstanding ribs 42 and 44 having an opening or space 46 therebetween. At the top of the launching channel 40 is mounted a one-way gate 48 so that a ball 20 launched upwardly along and from the launching channel 40 will travel onto the playing surface 16 but cannot roll back downwardly into the launching channel 40 past the gate 48. Space 46 permits a ball to pass therethrough back into channel 40 to give a player another "shot."

Looking again at FIG. 1, a flipper assembly generally comprises lefthanded and righthanded flipper members, generally designated 50L and 50R respectively, and lefthanded and righthanded flipper handles, generally designated 52L and 52R respectively. By operating flipper handles 52L and 52R, a player can move flipper members 50L and 50R, respectively, in the direction indicated by arrow A in FIG. 1. The movement of the flipper members in this manner in an attempt to hit a ball 20, will keep that ball 20 on the playing surface 16. If a ball 20 cannot be kept on the playing surface 16, it will ultimately roll downwardly into the ball storage area 38.

THE LAUNCHER

Turning now to FIGS. 1 and 7, the launcher 36 will be discussed in greater detail. The launcher 36 is seen to generally include a molded launcher housing 58 formed on the game housing 12, with an opening 60 (FIG. 7) communicating with the ball storage area 38 and a slot (not shown) formed in the side of the housing 58 opposite opening 60. A ball striking plunger 64 (FIG. 7) is reciprocally mounted within the launcher housing 58. The plunger 64 has a side trigger 66 (FIG. 1) formed thereon which is received in the slot formed in the housing 58. Mounted in back of the plunger 64 is a spring 68 (FIG. 7) for urging the plunger 64 forwardly.

By pulling the trigger 66 back in the slot, the plunger 64 assumes a cocked position (not shown). When the plunger 64 is in a cocked position, the front of it will be behind the opening 60 so that a ball 20 received in the ball storage area 38 will be able to roll in front of the plunger preparatory to launching. By releasing the trigger 66, a ball in front of the plunger 64 will be launched upwardly through the launching channel 40, through the one-way gate 48 and onto the playing surface 16.

FLIPPER ASSEMBLY

Turning now to FIGS. 1, 2 and 9, the flipper assembly will be discussed in greater detail. It is to be noted that there is a lefthanded and a righthanded flipper which have identical components. Accordingly, a discussion of one flipper is equally applicable to the other flipper. It also should be noted that only the lefthanded flipper assembly is shown in FIG. 9. All reference numerals to the lefthanded flipper assembly end with L. All reference numerals directed to the righthanded flipper assembly end with the letter R.

Each flipper handle 52L and 52R has a horizontal manually manipulatable portion 74L and 74R integrally connected to a vertical portion 76L and 76R. The vertical portions 76L and 76R have apertures 78L and 78R, respectively, formed near the bottom thereof and shaft protrusions 79L and 79R, respectively, formed near the top thereof.

Three horizontally spaced apart elements **80*a*, 80*b* and 80*c* are formed on the raised portion 18 of the housing 12 for rotatably mounting each flipper handle 52L and 52R. Flipper handle 52L is rotatably mounted between element 80*a* and 80*b* at its shaft protrusion 79L. Flipper handle 52R is rotatably mounted between element 80*b* and 80*c* at its shaft protrusion 79R.**

Two slots 82L and 82R are formed in the housing wall 14 to accommodate the movement of the vertical portion 76L and 76R of each flipper handle 52L and 52R. When thus mounted, each flipper handle 52L and 52R is rotatable in a vertical plane in the direction indicated by arrow B in FIGS. 3 and 9.

Looking again at FIGS. 1, 2, 3 and 9, each flipper member (50L and 50R) generally includes a ball hitting element (84L and 84R) which is adapted to strike a ball 20 rolling on the playing surface 16. The ball hitting elements 84L and 84R are fixedly secured to vertical legs 85L and 85R, respectively, of L-shaped rotatably mounted members, generally designated 86L and 86R.

The vertical legs 85L and 85R are received through an opening (not shown) formed in the playing surface 16. The horizontal legs 87L and 87R of the L-shaped members 86L and 86R each has an aperture 88L and 88R, respectively, formed near the free end thereof. Each flipper member 50L and 50R are thus mounted so that movement of the horizontal legs 87L and 87R in the direction indicated by arrow C in FIG. 9 will cause the respective ball hitting elements 84L and 84R to move in the direction indicated by arrow A of FIGS. 1 and 9.

Horizontally disposed linkage members 90L and 90R interconnect the flipper members 50L and 50R with their corresponding flipper handle 52L and 52R. Looking at FIG. 9, each of the linkage members 90L and 90R is seen to have a vertical post or shaft 92L and 92R formed at one end thereof and a horizontally disposed post or shaft 94L and 94R formed at the other end thereof. The vertical posts 92L and 92R are adapted to be received within apertures 88L and 88R, respectively. The horizontal posts 94L and 94R are adapted to be received in apertures 78L and 78R, respectively.

When thus mounted, linkage members 90L and 90R will move in a reciprocal horizontal manner to transmit any rotation of the flipper handles 52L and 52R into the desired rotation of the flipper members 50L and 50R. Specifically, when flipper handles 52L and 52R are rotated in the direction indicated by arrow B of FIGS. 3 and 9, the linkage members 90L and 90R are caused to move in the direction indicated by arrow D of FIGS. 3 and 9. This movement of linkage members 90L and 90R causes the horizontal legs 86L and 86R to rotate in the direction indicated by arrow C of FIG. 9 which, in turn, causes the ball hitting elements 84L and 84R to rotatingly move in the direction indicated by arrow A of FIGS. 1 and 9. When flipper handles 52L and 52R are released, they are biased by means of rubberbands 96L and 96R so that all the components return to their initial positions by moving in directions opposite that described above.

THE TARGETS

Figure 10:
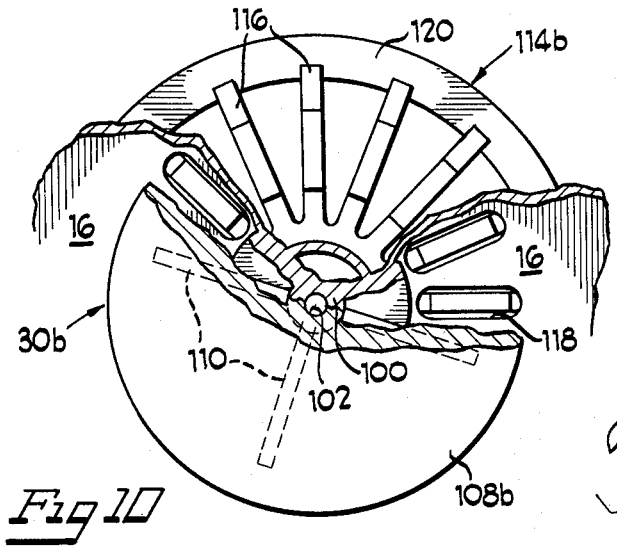
FIG. 10 is an enlarged, partially cutaway top plan view of a target and associated bumper switch employed in the pinball apparatus of the present invention.
Figure 11:
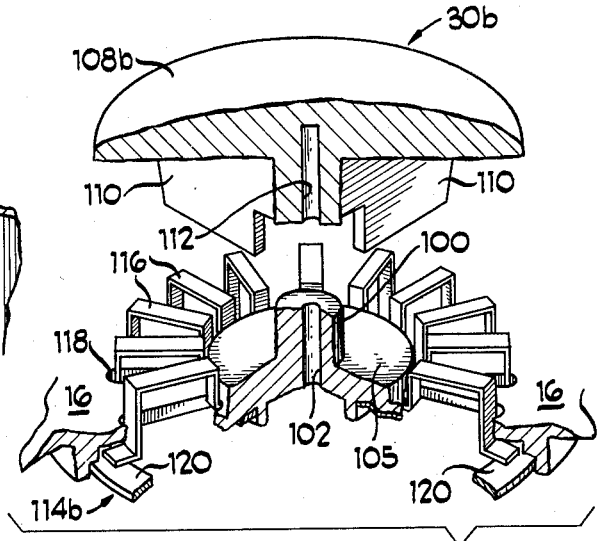
FIG. 11 is a partially cutaway, fragmentary sectional perspective view of the target and bumper switch shown in FIG. 10.

Turning now to FIGS. 3, 10 and 11, the targets **30*a*, 30*b* and 30*c* will be discussed in greater detail. It is to be understood that each target 30***a*, 30*b* and 30*c* is identical except for their location on the playing surface 16. Accordingly, only one of the three targets will be discussed herein. However, when it is important to note the difference of a component as between the three targets, the letter *a* will be added to a reference numeral pertaining to target 30*a*, the letter *b* will be added to a reference numeral pertaining to target 30*b*, and the letter *c* will be added to a reference numeral pertaining to target 30*c*. Otherwise, the same reference numeral will be used to designate the same component or element in each of the three targets.

Each target 30*a*, 30*b* and 30*c* includes a fixedly mounted vertical post member 100 having a cylindrical opening 102 formed therein (FIG. 11) through which a shaft 104*a*, 104*b* and 104*c* (FIG. 3) is rotatably mounted, and a circular base 105. Gears 106*a*, 106*b* and 106*c* are fixedly mounted on the bottom of shafts 104*a*, 104*b* and 104*c*, respectively, within the housing 12 for rotation therewith.

Generally circular umbrella-like top members 108*a*, 108*b* and 108*c* are fixedly secured to the top of shafts 104*a*, 104*b* and 104*c*, respectively, for rotation therewith (FIGS. 3 and 11). Each of the top members 108*a*, 108*b* and 108*c* has a plurality of depending ball pushing tabs 110 extending downwardly from the interior thereof and a downwardly facing opening 112 which is adapted to be press fit onto the top of shafts 104*a*, 104*b* and 104*c* for rotation therewith.

Each target 30*a*, 30*b* and 30*c* has a normally open bumper switch 114*a*, 114*b* and 114*c* (FIGS. 3, 10 and 11), respectively, associated therewith and mounted on the playing surface 16. Each bumper switch 114*a*, 114*b* and 114*c* is adapted to close whenever a ball 20 strikes one of the target members 30*a*, 30*b* or 30*c*.

More specifically, looking at FIGS. 10 and 11, each bumper switch 114*a*, 114*b* and 114*c* is seen to generally include a plurality of upside-down U-shaped movable electrical contacts 116, each having one end fixedly mounted to the base 105 of the post member 100 so that the free ends of the contacts 116 generally form the circumference of a circle. Contacts 116 are received through a like number of radial slots 118 formed in the playing surface 16. An annular stationary contact 120 is mounted in the housing immediately below the free ends of contacts 116. Whenever weight, in the form of a ball 20, is applied downwardly on one of the contacts 116, the free end thereof will move downwardly into contact with the annular contact 120 thereby closing a bumper switch 114*a*, 114*b* or 114*c*.

Turning now to the airplane target 32 in greater detail, it can be seen in FIGS. 1 and 3 that target 32 generally includes an airplane or rocket-shaped top member 122 supported on three posts 124. A resilient strand 126 is fit around the three posts 124 to provide a bouncing surface for a ball hitting the target.

Mounted under the top member 122 is a normally open bumper switch 128 (FIG. 3). The bumper switch 128 comprises a stationary contact 130 and a movable contact 132 near one edge of the target. The force of a ball striking the target 32 where the movable contact 132 is mounted causes the movable contact to move toward the stationary contact 130 thereby closing bumper switch 128.

A lightbulb 134 is mounted beneath the top member 122 of target 32. All of the bumper switches 114*a*, 114*b*, 114*c* and 128 are electrically connected to lightbulb 134 and are associated with the score indicator 34. Thus, when a ball 20 hits any of the target members 30*a*, 30*b*, 30*c* or 32 in such a way as to close the respective bumper switches 114*a*, 114*b*, 114*c* or 128, the light 134 is illuminated, a score is indicated on the score indicator and the top members 108*a*, 108*b* and 108*c* will rotate, as will be discussed in greater detail hereinafter. The rotation of top members will propel any ball 20 which moves into a ball receiving compartment formed between two ball pushing tabs 110 out onto the surface 16 by centrifugal force.

THE SCORE INDICATOR

Turning now to FIGS. 2 and 4, the score indicator 34 will be discussed in greater detail. The score indicator 34 is seen to generally include a cylindrical tube 140 having two stub shafts 142 and 144, one extending from each end of the tube. The tube has a solid spiral color, indicated by line 145, applied on its surface. Fixedly mounted on one shaft 142 at one end of the tube 140 is a reset wheel 146. Fixedly mounted on the other shaft 144 at the other end of the tube 140 is a ratchet gear 148. The score indicator 34 is rotatably mounted beneath the playing surface 16 within the housing 12 on a carriage 150. Specifically, the shafts 142 and 144 are journalled in the carriage 150.

A slot 152 (FIG. 1) is formed in the playing surface 16 immediately above tube 140 so that a longitudinal section of the tube surface can be observed. Thus, as the tube is rotated, looking at FIG. 1, it appears as though the solid color defined by line 145 rises or moves in slot 152 much like that of a thermometer. Appropriate indicia 153 is printed on playing surface 16 adjacent slot 152 so that the movement of the solid color can be calibrated into a score.

Each time a score is made by closing one of the bumper switches 114*a*, 114*b*, 114*c* or 128, the tube 140 is rotated a given increment, in a manner which will be described in greater detail hereinafter.

The top part of the reset wheel 146 is received through another slot 153 formed in the playing surface 16. In this manner, at the end of a game, in order to turn the score back to 0 or at its initial point, all the player has to do is move the reset wheel 146 thereby rotating tube 140.

The score indicator 34 also includes a leaf spring 154 mounted on the carriage 150 extending under reset wheel 146. The leaf spring 154 bears against the bottom of reset wheel 146 so that the tube will not be freely rotatable but will rotate only when a positive force is applied.

THE DRIVE MEANS

Figure 5:
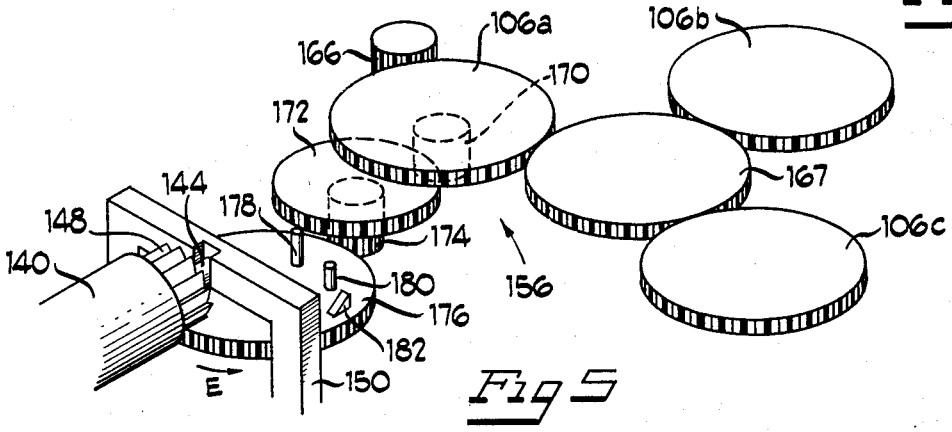
FIG. 5 is a generally enlarged perspective view of a portion of the scoring means employed in the pinball apparatus of the present invention.

Drive means, generally designated 156, is provided within the housing 12 for rotating the top members 108*a*, 108*b* and 108*c* of target members 30*a*, 30*b* and 30*c* and for rotating tube 140 to indicate a score during a defined "scoring period." Looking at FIGS. 2 and 4, the drive means 156 is seen to generally include an electric motor 158 mounted on a suitable supporting carriage 160 and connected to two conventional batteries 162 within the housing 12. The motor 158 has a drive shaft 164 having a motor pinion gear 166 fixedly secured thereto for rotation therewith. It can be seen that motor gear 166 is in meshing engagement with gear 106*a* (FIGS. 2 and 5).

Looking at FIGS. 3 and 10, a gear 167 is rotatably mounted on a depending post 168 within the housing 12. Gear 167 is in simultaneous meshing engagement with target gears 106*a*, 106*b* and 106*c*. Thus, when the motor 158 is actuated thereby causing the motor gear 166 to rotate, gears 106*a*, 106*b*, 106*c* and 167 will all be rotating simultaneously. Accordingly, whenever motor 158 is actuated, all of the top members 108*a*, 108*b* and 108*c* of targets 30*a*, 30*b* and 30*c* will rotate simultaneously during the scoring period.

A pinion gear 170 is fixedly mounted on shaft 104*a* and forms an integral part of gear 106*a*. Pinion gear 170 is in meshing engagement with gear 172 which has a pinion gear 174 formed integrally therewith. Gears 172 and 174 are rotatably mounted on an upstanding post formed on the bottom of carriage 160 (see FIG. 4). Pinion gear 174 is in meshing engagement with a control gear 176 which is rotatably mounted on another upstanding post 177 formed on carriage 160. Therefore, it can be seen that in addition to rotating all of the top members 108*a*, 108*b* and 108*c* of targets 30*a*, 30*b* and 30*c*, the motor 158 also rotates the control gear 176 in the direction indicated by arrow E of FIG. 5 through gears 106*a*, 170, 172 and 174 during the scoring period.

The rotating of the control gear 176 operates various functions of the pinball apparatus 10 such as moving the score indicator 34 and deactivating the motor 158 indicating the end of the scoring period. To this end, there is formed on the upper surface of control gear 176 three blinker pins 178, one interrupter pin 180 and a scoring pawl 182.

Mounted in the carriage 160 immediately above control gear 176 is a normally open blinker switch, generally designated 184 (see FIGS. 2 and 6). The purpose of the blinker switch 184 is to blink light 134 after a score has been effected during the scoring period. Looking at FIG. 2, the blinker switch 184 is seen to generally include a stationary contact 186 and a movable contact 188 both embedded in the carriage 160. The distance that the contacts 186 and 188 are above the surface of control gear 176 is such that blinker pins 178 can engage only the movable contact 188. Interrupter pin 180 and scoring pawl 182 are too low to ever touch movable contact 188.

As the control gear 176 rotates, the blinker pins 178 will close the normally open blinker switch 184 by moving the movable contact into touching relation with the stationary contact 186. This occurs three times during every revolution of the control gear 176. Every time the blinker switch 174 is closed, lightbulb 134 flashes. When the blinker switch is open, lightbulb 134 is off. Thus, during every revolution of control gear 176, lightbulb 134 will flash on and off three times.

Also mounted in carriage 160 is a normally closed interrupter switch, generally designated 190 (see FIGS. 2 and 6) which, when opened, stops the motor 158 from running and ends the scoring period. Looking at FIG. 2, the interrupter switch 190 includes a stationary contact 192 and a flexible, springy movable contact 194 both embedded in carriage 160. The interrupter switch 190 is mounted a distance above control gear 176 and extends a distance from the carriage 160 so that only interrupter pin 180 can engage the movable contact 194.

As control gear 176 rotates, the interrupter pin 180 will engage the end of movable contact 194 and flex it against the stationary contact 192. The end of the movable contact 194 will then give way allowing the interrupter pin 180 to pass the interrupter switch 190. When this occurs, the end of the movable contact 194 is sprung in the direction indicated by arrow F in FIG. 2 in response to the release thereof by the interrupter pin 180. This action momentarily spaces contacts 192 and 194 thereby opening the interrupter switch 190. The "open" position of switch 190 lasts only a very short period of time because movable contact 194 will spring back to its initial "closed" position.

As the control gear 176 rotates, scoring pawl 182 will engage ratchet gear 148 on the scoring indicator 34. Every time the scoring pawl engages ratchet gear 148 and passes it, tube 140 will be rotated a given increment (i.e., for every rotation of control gear 176).

SOUND PRODUCING MEANS

Associated with the drive means 156 is sound producing means, generally designated 202, as best shown in FIG. 2. The sound producing means 202 serves to give an audible sound during the scoring period whenever a score has been made.

The sound producing means is seen to generally include an elongated plunger 204 having a slot 206 and a square hole 208 formed therein. The plunger is reciprocally mounted in the housing 12 by means of a bracket 210 on which one end of the plunger 204 rests and a guide pin 212 received in slot 206. An eccentric 214 is fixedly mounted on shaft 104*c* immediately below gear 106*c* and is adapted to be received within the square hole 208. Looking at FIG. 2, it can be seen that when the motor 158 is actuated, gear 106*c* will rotate as already described above along with the eccentric 214. The rotation of the eccentric 214, within the square hole 208 causes reciprocal movement of the plunger 204.

A noise maker 216 is mounted within the housing 12 immediately adjacent one end 217 of plunger 204. The noise maker 216 generally comprises two open pipes 218*a* and 218*b* each having a musical or other noise-making reed 220*a* and 220*b* mounted therein. A flexible diaphragm 222 covers the end of the noise maker adjacent the end 217 of plunger 204.

When plunger 204 reciprocates, its end 217 oscillates the flexible diaphragm 222. The flexing of diaphragm 222 causes air to pass through pipes 218*a* and 218*b*. The rushing of the air past reeds 220*a* and 220*b* causes a flute-like sound to emanate therefrom.

THE TUNNEL ASSEMBLY

A feature of the present pinball apparatus 10 is the provision of a tunnel assembly, generally designated 228, as best seen in FIGS. 8, 2 and 3. Looking at these figures, the tunnel assembly 228 is seen to generally include an inclined channel 230 having an upper end 232 with two curved ridges 233 and a translucent curved lower end defining a ramp 234. A ball received in the upper end is intended to roll by virtue of gravity down the tunnel formal channel 230 toward the lower end 234 thereof. The channel 230 is mounted within the housing 12 immediately below the playing surface 16. Cutouts 235 are formed near a top portion of channel 230 in order to accommodate gears 106*b* and 167.

Associated with the upper end 232 of the channel is entrance means, generally designated 236 (FIGS. 1 and 3), for providing means by which a ball 20 can be introduced from the playing surface 16 to the upper end 232 of channel 230. The entrance means generally includes an opening 237 formed in the surface 16 through which a ball 20 can fall into the channel 230. Over the opening 237 is mounted a carousel member 238 having a vertical post portion 240. A freely rotatable disc member 242 having a hollow shaft portion 244 with a cylindrical opening therein is mounted on the post portion 240 for rotation with respect thereto. The disc member 242 has three ball-sized openings 246 and a plurality of ball pushing tabs 248 extending from the hollow shaft portion 244 outwardly therefrom between the openings 246. As can be seen best in FIG. 3, the playing surface 16 is somewhat recessed immediately below said disc member 242 so that the top surface of said disc member is generally flush with the playing surface 16.

A ball 20 coming in contact with the entrance means 236 will be captured in one of the three openings 246 between two ball pushing tabs 248. Because the playing surface 16 is inclined, and because the disc member 242 is freely rotatable, a captured ball will cause the disc member 242 to rotate by virtue of gravity until the ball 20 is over opening 237. When this occurs the ball in an opening 246 will fall through the opening 237 in the surface 16 into the channel 230.

Associated with the lower end 234 of the channel 230 is exit means, generally designated 250, as best seen in FIGS. 3 and 8. The purpose of the exit means is to provide means by which a rolling ball 20 can move from the lower end 234 of channel 230 back onto the playing surface 16 for further play.

The exit means 250 generally includes a rectangular opening 251 (FIG. 1) in the playing surface 16 immediately in front of the flipper members 50L and 50R and a lever member, generally designated 254, pivotally mounted on the channel 230. The lever member 254 includes a centrally located shaft 255 (FIG. 2) which is journalled in the side walls of channel 230 at pivot points 256. At one end of the lever member 254 is a translucent rectangular plate portion 258 of substantially the same size as the rectangular opening 251 in playing surface 16 to define a cover therefor. At the other end of the lever member 254 is a counterweight 260. The lever member 254 is balanced so that the moment the cover 258 about pivot 256 is just slightly more than the moment caused by counterweight 260 about pivot 256. Because of this, the lever member 254 is normally in the position shown in FIGS. 1, 3 and 8, that is wherein the cover 258 covers the rectangular opening 251.

A ball 20 rolling down inclined channel 230 will ride up the ramp 234 at the lower end of the channel and ultimately will strike the bottom of the cover portion 258. Because the lever arm is substantially balanced as described above, the impact of ball 20 will rotate the lever member 254 in the direction indicated by arrow H in FIGS. 3 and 8. The momentum of ball 20 after striking the cover portion 258 will allow the ball 20 to continue to move back onto the playing surface 16 near the flippers 84L and 84R. Shortly after the lever member 254 is rotated in the direction indicated by arrow H, it rotates back down to its initial position by means of gravity.

Mounted below the translucent lower end 234 of channel 230 is a tunnel lightbulb 262 within a light housing 263. Tunnel lightbulb 262 is electrically connected to a normally open mechanical jiggle switch, generally designated 264, mounted in the upper end 232 of the channel 230. The jiggle switch 264 includes a stationary contact 266 and a movable contact 268 embedded in the floor of the channel 230. The stationary contact 266 is generally vertical and the movable contact 268 is much longer than the stationary contact 266 and has a horizontal portion 269 spaced from and overlying the top of the vertical stationary contact 266 and underlying opening 237. The movable contact 268 is very flexible and has a counterweight 270 formed at the free end of the horizontal portion 269.

When a ball 20 drops through opening 237, it will strike the horizontal portion 269 of the movable contact 268. The force of the dropping ball 20, combined with the flexibility of the horizontal portion 269, causes the movable contact 268 to vibrate against contact 266. Thus, the jiggle switch 264 closes and opens a plurality of times in rapid succession. Every time the jiggle switch 264 closes, the tunnel lightbulb 262 flashes on. The flash from light 262 can be observed through the translucent lower end 234 of the inclinded channel 230 and the translucent cover 258 of the lever member 254 to signal the entrance of a ball into the channel.

As can be seen in FIG. 1, the ball 20 coming out of the tunnel assembly 228 through the rectangular opening, is aimed directly through the space between the two flipper members 50L and 50R. If the ball 20 were allowed to travel this path, it would be impossible for a player to successfully hit the ball to keep it on the playing surface. To prevent this, there is provided a bumper post 272 mounted on the playing surface 16 between the rectangular opening and the two flipper members 50L and 50R. Thus, when a ball comes out of the channel 230, the ball 20 will hit the bumper post 272 thereby deflecting it either toward one flipper member or the other.

The tunnel assembly 228 functions as sort of a hazard in the pinball apparatus shown herein. A ball captured in the entrance means 236 comes out of the exit means 250 without scoring a point. In addition, the player has to be ready to strike the ball immediately after it comes out of the rectangular opening or else it will pass out of play and end up in the ball storage area 38. Of course, a scoring scheme could be devised.

THE CIRCUIT

Figure 12:
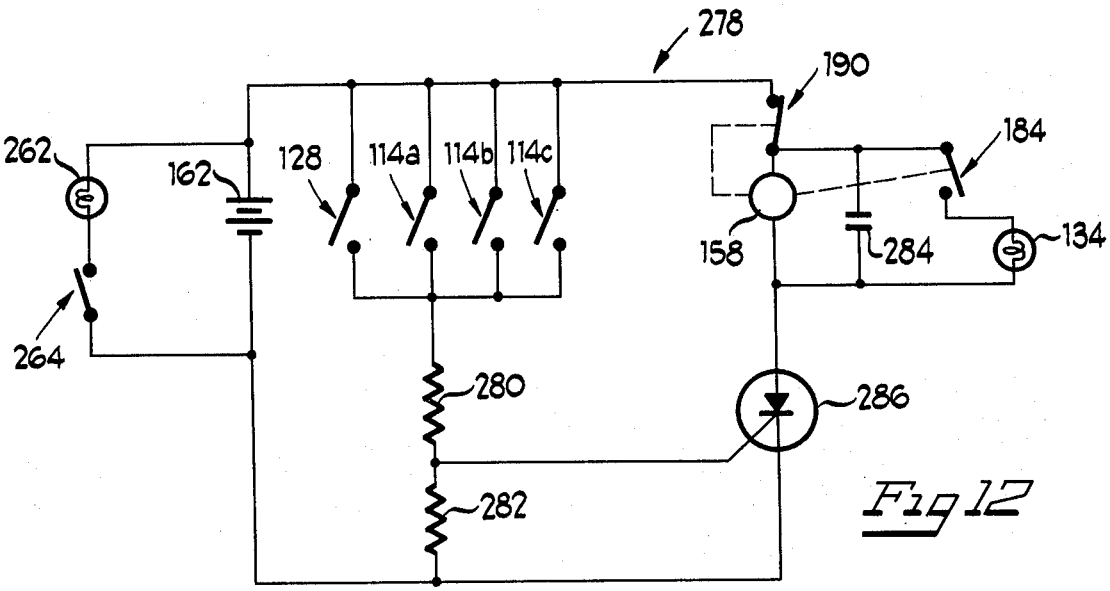
FIG. 12 is a schematic electrical circuit employed in the pinball apparatus of the present invention.

When discussing the drive means above, it was noted that whenever one of the bumper switches **114*a*, 114*b*, 114*c* or 128 were closed, the control gear 176 would make one revolution which defines the scoring period. During the scoring period, the tube 140 of the score indicator 34 is turned one increment. The means by which the control gear 176 is turned only one revolution is a normally incomplete circuit 278 as shown in FIG. 12.**

The circuit 278 includes the batteries 162 which are in series with the tunnel lightbulb 262 and the jiggle switch 264. Also connected to the batteries 162 are the bumper switches **114*a*, 114*b*, 114*c* and 128 in series with two resistors 280 and 282. The motor 158 and the interrupter switch 190 are in parallel with the interrupter switch and resistors. In parallel with the motor 158 is a capacitor 284 and the blinker switch 184 and lighbulb 134.**

An electronic switch 286 in the form of a silicone controlled rectifier (SCR) is employed in the circuit 278 for determining when electricity is to flow through the circuit. The SCR is changeable between a normally "off" or "nonconducting" state preventing the flow of electricity thereby and an "on" or "conducting" state when electricity is allowed to flow through the circuit 278.

Resistors 280 and 282 serve to initially bias the SCR 286 so that it normally is almost at a conducting or "on" state. The initial state is characterized by the potential SCR anode current below the value of the specified "holding current" which is the minimum anode current required to maintain SCR in an "on" state. The SCR 286 changes from its "off" to its "on" state in response to an electrical impulse through its gage electrode caused by the closing of one of the bumper switches 114*a*, 114*b*, 114*c* or 128.

It is the nature of a complementary silicone controlled rectifier that once it is turned "on" it will remain "on." The only manner in which the SCR can be turned "off" is by reducing its anode current to a level below the value of its specified "holding current." To this end, there is provided the interrupter switch 190 which opens the circuit momentarily.

The interrupter switch 190 is movable as already discussed above between a normally "closed" position and an "open" position. The SCR goes from an "on" state to an "off" state whenever the interrupter switch 190 goes from a "closed" to an "open" position thereby opening up the circuit 278. The interrupter pin 180 serves the purpose of moving the normally "closed" interrupter switch 190 from its "closed" position to its "open" position.

Initially circuit 278 is not conducting electricity. Thus, the SCR 286 is "off," the interrupter switch 190 is "closed" because movable contact 194 is biased against the stationary contact 192, and the motor 158 is not running. When one of the bumper switches 114*a*, 114*b*, 114*c* or 128 is closed momentarily by the impact of a ball, an electrical impulse is directed to the gate electrode of the SCR 286. The additional electrical impulse causes the SCR to shift from its "off" to its "on" state thereby allowing electricity to flow through the circuit 278. This causes motor 158 to be initially actuated. At this time, when the SCR is initially fired, the interrupter switch 190 is still in a "closed" position. However, motor 158 is turning the control gear 176 in the direction of arrow E until interrupter pin 180 is moved into engagement with the movable contact 194. When the interrupter pin 180 releases movable contact 194 as described above, the interrupter switch 190 is momentarily caused to go from its "closed" position to its "open" position thereby cutting off the electricity flowing through the circuit 278. This turns the SCR 286 to its "off" state. Because the SCR 286 is an "off" state, circuit 278 cannot conduct electricity and motor 158 is shut off. Circuit 278 will not connect again until the next time one of the bumper switches 114*a*, 114*b*, 114*c* or 128 is momentarily closed.

Because there is but one interrupter pin 180 formed on the control gear 176, the SCR will be in an "on" state and the motor 158 will remain running exactly one revolution of the control gear 176. This defines the scoring period.

OPERATION

In operation, the pinball apparatus 10 of the present invention is played like most conventional pinball games. That is, the ball 20 is launched on the playing surface 16 where it strikes either the bumpers 22*a*, 22*b*, 24*a*, 24*b*, 26*a*, 26*b*, 28*a*, 28*b* and 28*c* and/or the targets 30*a*, 30*b*, 30*c* and 32. The player operates the flipper handles 52L and 52R in order to make the flipper members 50L and 50R strike a rolling ball 20 in an effort to keep the ball on the playing surface and prevent the ball from going to the ball storage area 38.

The tunnel assembly 228 is employed to add a hazard to the game. A ball captured in the entrance means 236 rolls down channel 230 and out the exit means 250 without registering a score.

If a ball strikes a target 30*a*, 30*b*, 30*c* or 32 and closes a bumper switch 114*a*, 114*b*, 114*c* or 128 respectively, the drive means 156 will be actuated for a given scoring or operating period. The actuation of the drive means performs four different functions simultaneously. First, the drive means 156 rotates tube 140 one increment during the operating period. Second, the drive means 156 actuates the sound producing means during the operating period. Third, the drive means 156 causes lightbulb 134 to flash on and off during the operating period. Fourth, the drive means 156 spins top members 108*a*, 108*b* and 108*c* during the operating period.

As discussed above, when the drive means is actuated and top members 108*a*, 108*b* and 108*c* are rotated, a ball 20 received within a compartment of a target 30*a*, 30*b* or 30*c* (defined between two ball pushing tabs) will be propelled out from the targets onto the playing surface by centrifugal force. The ball 20 will be propelled out during the beginning of an operating period. However, the operating period is of a duration longer than the time it takes a target 30*a*, 30*b* or 30*c* to propel the ball 20. During the remainder of the operating period, the propelled ball may be received in other target compartments of different targets and be propelled therefrom as described above. Therefore, a ball 20 may be propelled over the playing surface 16 a number of times in a number of different directions during one operating period. This ricochet effect adds to the skill and entertainment of the game.

The foregoing detailed description has been given for clearness of understanding only and no unnecessary limitations should be understood therefrom as some modifications will be obvious to those skilled in the art.

I claim:

1. In a pinball apparatus including a housing having an inclined playing surface over which a ball may be propelled, at least one ball to be propelled on said playing surface, and a launcher for propelling a ball onto the playing surface, wherein the improvement is a tunnel assembly comprising:

an inclined channel formed within the housing beneath the playing surface and having an upper end and a lower end whereby a ball in said channel will roll from the upper end to the lower end;

entrance means mounted on the playing surface above said upper end of the channel for capturing a ball and allowing said ball to be introduced into the channel; said entrance means including an entrance opening formed in said playing surface over the upper end of said channel and a freely rotatable carousel member having plural compartments formed therein about a rotatable axis for capturing and holding a ball, each compartment including an opening formed in and substantially encircled by a bottom floor thereof for movement therewith and for alignment with said entrance opening whereby a ball captured in any one of said compartments will drop through the opening therein and through said entrance opening into the upper end of the channel when said carousel member rotates so that said openings are aligned, and abutment means spaced from each of said compartment openings about the periphery of said carousel for engagement by a second ball for rotating the carousel relative to said entrance opening; and exit means associated between the lower end of the channel and the playing surface for allowing a ball which drops into the upper end of said channel to be introduced back onto the playing surface in a position for further play.

2. In a pinball apparatus including a housing having an inclined generally planar playing surface over which a ball may be propelled, at least one ball to be propelled on said playing surface, and a flipper assembly for striking a ball in play in order to keep said ball in play, said flipper assembly having a ball hitting portion rotatably mounted about a generally vertical axis on said surface for striking said ball and actuating means for rotating said ball hitting portion, the improvement in said actuating means comprising:

a manually operable means mounted for reciprocal movement in a direction generally perpendicular to the plane of said playing surface; and linkage means operably connecting said manually operable means with said ball hitting portion for transmitting said reciprocal movement of said manually operable means generally perpendicular to the plane of the playing surface into reciprocal movement of said ball hitting portion generally parallel to said plane of said playing surface.

3. The apparatus of claim 2 wherein said manually operable means is pivotally mounted about a horizontal axis and includes a first crank portion for pivoting in a generally vertical plane, said ball hitting portion includes a second crank portion formed thereon for pivoting in a generally horizontal plane, and wherein said linkage means includes a single horizontally disposed elongated member pivotally connected at its opposite ends to said first crank portion and said second crank portion, whereby up and down movement of said manually operable means causes reciprocal movement of said elongated member which pivots said ball hitting portion about said vertical axis.

4. In a pinball apparatus including a housing having an inclined playing surface over which a ball may be propelled, at least one ball to be propelled on said playing surface, and a launcher for propelling a ball onto the playing surface, wherein the improvement is a tunnel assembly, comprising:

an inclined channel formed within the housing beneath the playing surface and having an upper end and a lower end whereby a ball in said channel will roll from the upper end to the lower end;

entrance means mounted on the playing surface above said upper end of the channel for capturing a ball and allowing said ball to be introduced into the channel; and signal means for indicating when a ball has been introduced into the channel, said signal means comprising a signal light forming a part of a normally incomplete electrical circuit and a normally open switch having one flexible contact in position for engagement by a ball introduced into said channel, said contact vibrating between a closed position and an open position for a plurality of cycles after engagement by the ball to flash the signal light on and off at least more than one time.

5. In a pinball apparatus including a housing having an inclined playing surface over which a ball may be propelled, at least one ball to be propelled on said playing surface, and a launcher for propelling a ball onto the playing surface, wherein the improvement is a tunnel assembly comprising:

an inclined channel formed within the housing beneath the playing surface and having an upper end and a lower end whereby a ball in said channel will roll from the upper end to the lower end;

entrance means mounted on the playing surface above said upper end of the channel for capturing a ball and allowing said ball to be introduced into the channel; and exit means associated between the lower end of the channel and the playing surface for allowing a ball to be introduced back onto the playing surface in a position for further play wherein said exit means includes an exit opening formed in said playing surface over the lower end of said channel, an upwardly curved chute portion at the lower end of said channel terminating at said playing surface for directing a ball out of the channel onto the playing surface, and a lever member pivotally mounted on the lower end of said channel, said lever member having a counterweight portion at one end of its pivot point and a cover portion at the other end of said pivot point, said cover portion normally covering said exit opening to be struck by a ball rolling up said chute portion whereby the impact of a ball will pivot the lever member so that the cover portion will uncover the exit opening and allow the ball to roll onto said surface.

* * * * *